US006325474B1

(12) United States Patent
Betzold et al.

(10) Patent No.: US 6,325,474 B1
(45) Date of Patent: Dec. 4, 2001

(54) DEVICE FOR WRITING ON THERMOGRAPHIC MATERIAL

(75) Inventors: Wolfram Betzold, Höhenkirchen (DE); Leo Oelbrandt, Kruibeke (BE); Friedrich Stumpf, München; Thomas Zehetmaier, Neufahrn, both of (DE); Ivan Hoogmartens, Wilrijk (BE); Luc Leenders, Herentals (BE); Hans Strijckers, Oudergem (BE); Herbert Gebele, Sauerlach; Franz Kappeler, Puchheim, both of (DE)

(73) Assignee: AGFA Gevaert AG, Leverkusen (DE)

( * ) Notice: Subject to any disclaimer, the term of this patent is extended or adjusted under 35 U.S.C. 154(b) by 0 days.

(21) Appl. No.: 09/529,943

(22) PCT Filed: Oct. 22, 1998

(86) PCT No.: PCT/EP98/06701

§ 371 Date: Apr. 19, 2000

§ 102(e) Date: Apr. 19, 2000

(87) PCT Pub. No.: WO99/21719

PCT Pub. Date: May 6, 1999

(30) Foreign Application Priority Data

Oct. 25, 1997 (DE) ..... 197 47 302

(51) Int. Cl.[7] ..... B41J 2/435; B41J 2/447; B41J 2/455

(52) U.S. Cl. ..... 344/224; 347/187

(58) Field of Search ..... 347/185, 187, 347/224, 171

(56) References Cited

U.S. PATENT DOCUMENTS

| | | | |
|---|---|---|---|
| 4,804,975 | 2/1989 | Yip | 346/76 |
| 4,903,042 | 2/1990 | Käufl et al. | 346/76 |
| 5,104,767 | 4/1992 | Nakamura | 430/138 |
| 5,164,742 | * 11/1992 | Baek et al. . | |
| 5,168,288 | * 12/1992 | Baek et al. . | |
| 5,258,776 | * 11/1993 | Guy et al. . | |
| 5,552,818 | 9/1996 | Agano et al. | 347/133 |
| 5,598,272 | 1/1997 | Fisch et al. | 258/298 |

FOREIGN PATENT DOCUMENTS

| | | |
|---|---|---|
| 34 32 824 A1 | 9/1984 | (DE) . |
| 0 424 175 A2 | 10/1990 | (EP) . |
| WO 92/16374 | 10/1992 | (EP) . |
| 0 734 870 A2 | 4/1996 | (EP) . |
| 0 836 116 | 8/1997 | (EP) . |

OTHER PUBLICATIONS

Laser Array Printer, IBM Technical Disclosure Bulletin, vol. 32, No. 5A, pp. 114–115, Oct. 1989.*

JP–Abstracts; (Kanzaki) 58148777.

JP–Abstracts; 9,048,144 (Fuji).

JP–Abstracts; 9,048,143 (Fuji).

JP–Abstracts; 9,048,142 (Fuji).

(List continued on next page.)

*Primary Examiner*—Huan Tran
(74) *Attorney, Agent, or Firm*—Darby & Darby

(57) ABSTRACT

The invention relates to a device (1) for writing on thermographic material (5). The inventive device (1) comprises a heater (20) with which the thermographic material (5) is preheated to a temperature, which is lower than a writing temperature. The thermographic material (5) can be written on with a writing instrument (10) which is distanced from the thermographic material (5) after input of an information signal (s(t)). The writing instrument (10) has a plurality of individually controllable point sources (30–33; 51–53). The thermographic material (5) can be written on in a point-by-point manner with said point sources (30–33; 51–53).

9 Claims, 2 Drawing Sheets

OTHER PUBLICATIONS

JP–Abstracts; 9,020,021 (Fuji).
JP–Abstracts; 9,020,028 (Fuji).
JP–Abstracts; 8,267,799 (Fuji).
JP–Abstracts; 6,001,071 (Konica).
JP–Abstracts; 5,297,589 (Konica).
GB–Abstracts; 20 80 964 (Polychrome).
EP–Abstracts; 0 488 648 (Canon).
EP–Abstracts; 0 558 078 (Fuji).
EP–Abstracts; 0 565 460 (Eastman Kodak).
DE–Abstract; 33 10 120 (Schulzen).

* cited by examiner

DEVICE FOR WRITING ON THERMOGRAPHIC MATERIAL

BACKGROUND OF THE INVENTION

1. Field of the Invention

The present invention relates to a device for writing on thermographic material. This device includes a heater for pre-heating the thermographic material to a temperature below a writing temperature required for writing on the thermographic material, and a writing instrument for writing on the thermographic material according to a predefined information signal s(t), wherein the writing instrument is spaced apart from the thermographic material.

2. Description of the Related Art

A device of this type is described in EP 0 734 870 A2. This known device preheats a thermographic material using a heater in form of a rotatably supported heater drum to a temperature below a writing temperature of the thermographic material. The pre-heating step, however, is designed to not induce writing on the thermographic material. The light beam of a single laser is projected on the thermographic material using an optical device. The laser is modulated with an information signal. The thermographic material includes a layer for converting radiation energy into thermal energy. When the modulated laser beam impinges on this layer, thermal energy corresponding to the information signal is produced in the thermographic material. The thermal energy is superimposed on the thermal energy produced by the pre-heating step, thereby exceeding the writing temperature of the thermographic material. The thermographic material is thereby blackened with a density variation corresponding to the information signal modulating the laser. The blackening of the thermographic material occurs row-by-row, with the pixels of the row being blackened consecutively. The optical device projecting the laser beam on the thermographic material has a polygon mirror which rotates at a very high rotation speed. The laser beam is reflected by the polygon mirror, so that the entire row of the thermographic material can be blackened by the laser beam. The laser beam is aimed from one end of the row of the thermographic material to the other end. To blacken the next row of the thermographic material, the heater drum and thus also the thermographic material are rotated by another row width.

The known device requires a complex mirror and lens arrangement for focusing and steering the laser beam to write the entire row. Since the required optical path is quite long, it may not be possible to accurately steer the laser beam. Moreover, the polygon mirror must be adjusted and supported very precisely and also has to rotate at an extremely high rotation speed so that the material can be blackened in a sufficiently short time.

EP 0 424 175 A2 describes a device for exposing photosensitive material.

This device has a plurality of individually addressable light emitting diodes (LED) arranged side-by-side, so that the light sensitive material can be exposed pixel-by-pixel. A lens arrangement is placed between the LED's and the photosensitive material to focus the light beams emitted by the LED's. The known exposure device can eliminate intensity variations between adjacent pixels by transmitting an identical light energy to the pixels in a region of the light sensitive material. LED's emit light at very low energy and can therefore not be used to write on thermographic material.

It is therefore the object of the present invention to provide a compact device based on conventional devices, which makes it possible to write on thermographic material in a simple manner.

SUMMARY OF THE INVENTION

The device according to the invention for writing on thermographic material includes a writing device having a plurality of individually addressable point sources, wherein the point sources can be used to write on the thermographic material pixel-by-pixel based on a specified information signal.

The invention advantageously obviates the need for a polygon mirror. Since the writing instrument is spaced apart from the thermographic material, the writing instrument does not directly contact the material, thereby preventing damage and abrasion of the writing instrument as well as of the thermographic material.

At least a portion of the individually addressable point sources can be addressed at the same time, so that writing on the thermographic material is very fast, since the points of the thermographic material associated with the simultaneously addressed point sources can be written almost simultaneously. The pixel may also be written over a longer time period, thereby increasing the response time for each individual point source for writing the pixel associated with the point source. As a result, the power to be produced by each point source for writing the pixel associated with the point source can advantageously be kept small, because the respective point source has more time to write the pixel. Moreover, the required response time required by the respective point source to react to a change in the signal setting can be relatively long. Consequently, a less complex technology can be used for implementing the point sources.

In an advantageous embodiment of the invention, each of the individually addressable point sources includes a laser. During operation of the device of the invention, the laser emits a laser beam which impinges on the layer of the thermographic material which converts the radiation energy of the laser beam to thermal energy. Advantageous, lasers provide sufficiently high power and can be easily modulated with a signal source.

Advantageously, several point sources can be connected in parallel so as to commonly write a single pixel of the thermographic material. The power to be produced by each of the point sources connected in parallel for writing the associated pixel on the thermographic material can thereby be reduced according to the number of point sources connected in parallel.

According to another advantageous embodiment of the invention, means for controlling the radiation energy emitted by the point sources are disposed between the writing instrument and the thermographic material. In the case where each of the point sources includes a single laser, the means for controlling the radiation energy is simply an optical lens. In this way, the beam path of the emitted radiation energy of the individual point sources can be corrected so that the radiated energy, in particular when the point sources are connected in parallel, is concentrated in the associated pixel of the thermographic material.

In a particularly advantageous embodiment of the invention, where each of the point sources includes one respective laser, the lasers are arranged in two rows on a semiconductor material, wherein the lasers of one row are offset relative to the lasers in the other row. In this way, the lasers are sufficiently spaced apart during manufacture so that the semiconductor material can be separated between two lasers. This approach considerably simplifies the fabrication of the writing instrument for a suitable number of lasers.

Advantageously, heating is provided in the form of a rotatably supported, inductively heated drum. A first and second pressure roller can be employed to press the thermographic material against the drum. The writing instrument is arranged so that the emitted radiation of the individual point sources of the writing instrument impinges on the thermographic material between the two pressure rollers. By pressing the thermographic material against the drum, the thermographic material is heated during the writing step which significantly simplifies the writing process of the thermographic material. The lasers need only supply a low power. In addition, the two pressure rollers can also be used to guide and advance the thermographic material.

At least one additional pressure roller may advantageously be placed before the first pressure roller. In this way, the thermographic material is pre-heated for a longer time before being written by the laser, so that even a relatively low heating temperature of the drum produces a sufficiently high pre-heating temperature in the thermographic material. The thermographic material can be written very fast due to the longer heated path traveled by the thermographic material across the drum surfaces. Accordingly, the drum can be rotated very rapidly while still maintaining a sufficiently high pre-heat temperature.

The pressure rollers can be constructed to have a small heat capacity or may be insulated and not absorb heat at all. With this arrangement, no thermal energy is stored in the pressure rollers and transferred to the thermographic material. Otherwise, the thermal energy stored in the pressure rollers and the thermal energy supplied by the heated drum would be superimposed and cause unwanted blackening of the thermographic material.

The point sources of the writing instrument can be easily addressed digitally with pulse-width modulated signals. In this way, the pixels associated with the point sources can be written precisely on the thermographic material.

Additional advantageous embodiments of the invention are disclosed in the dependent claims.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWING

The invention and its advantages will be described hereinafter with reference to embodiments and the drawings.

It is shown in.

DETAILED DESCRIPTION OF THE PRESENTLY PREFERRED EMBODIMENTS

Figure 1:
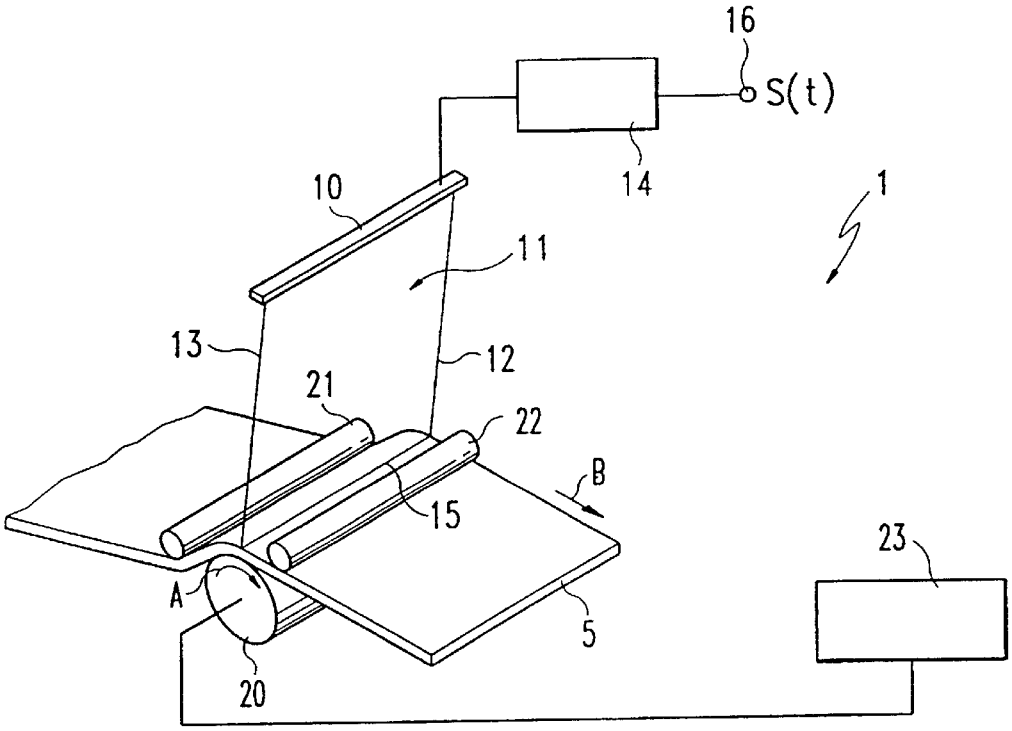
FIG. 1 a first embodiment of the device according to the invention for writing on thermographic material, FIG. 2 a second embodiment of the device according to the invention depicting the beam path of the point sources in operation, FIG. 3 an arrangement of several point sources on a semiconductor material, and FIG. 4 a third embodiment of the device according to the invention with several pressure rollers.

In the following, the same reference numerals are used for identical elements of the embodiments or for elements performing the same function.

FIG. 1 shows a first embodiment of the writing device 1 according to the invention for writing on thermographic material 5. The writing device 1 includes a laser row 10 which represents a writing instrument for writing on the thermographic material 5 using a specified information signal s(t). The information signal s(t) is applied to an input interface 16 of a laser row controller 14 and includes information about an image to be recorded on the thermographic material 5. The information signal s(t) applied to the input interface 16 can originate, for example, from a recording device for medical applications. The information signal s(t) used to address the laser row 10 is processed in the laser row controller 14. The laser row includes a plurality of individually addressable lasers which are directed towards the thermographic material 5. The laser row 10 can be used to write on a row 15 of the thermographic material 5 by blackening the thermographic material 5. The laser row 10 is spaced apart from the thermographic material. An optical device (not shown) can be placed between the individual lasers of the laser row 10 and the thermographic material 5 for focusing the laser beams.

In the present embodiment, the individual lasers of the laser row 10 are addressed with pulse width modulated signals. These pulse width modulated signals are generated by the laser row controller 14 based on the information signal. The pulse width modulated signals generated by the laser row controller 14 are applied to the individual lasers of the laser row 10 via an electrical connection. The lasers are modulated with the pulse width modulated signals and emit an intensity-modulated laser beam in the direction of the thermographic material 5, which in the present example is a thermographic film. The totality of the laser beams emitted by the laser row 10 is indicated in FIG. 1 by the reference numeral 11. FIG. 1 depicts the laser beam 12 of the outermost right laser and the laser beam 13 of the outermost left laser of the laser row 10.

The writing device 1 according to the invention illustrated in FIG. 1 includes a heater in the form of a rotatably supported, inductively heatable drum 20. In this way, the temperature of the drum 20 can be controlled almost without dead time, and a relatively small drum 20 having a small heat capacity can be used. However, a different heatable drum may also be employed.

The drum 20 can be rotated in a rotation direction A and is connected to a drum heater controller 23 capable of controlling the temperature to which the drum 20 is heated. The drum 20 is located directly underneath the laser row 10. The thermographic film 5 can be brought into contact with the drum 20 between the laser row 10 and the drum 20. For improving the contact and for guiding and transporting the thermographic film 5, the writing device 1 has two pressure rollers 21 and a 22 which are arranged between the laser row 10 and the drum 20 in such a way that the thermographic film 5 can be driven, on one hand, between the pressure rollers 21 and 22 and, on the other hand, the drum 20. The pressure roller 21 is disposed before row 15 of the thermographic film 5 whereas the pressure roller 22 is disposed after row 15. The two pressure rollers 21 and 22 press the thermographic film 5 against the drum 20, enabling the thermal energy emitted by the drum 20 to heat the thermographic material before and during the writing process. The thermographic film 5 is then transported to a feed device B.

The pre-heating time is determined by the rotation speed of the drum 20 and the spacing between the contact point of the first pressure roller 21 on a heated drum 20 and the location where the pixels are written on the thermographic film 5. The thermographic film 5 typically requires between 0.3 and 0.5 seconds to reach the temperature of the drum 20. The temperature of the drum 20 is advantageously between 110 and 115° C. The temperature has to be lower than the temperature required to write on the thermographic material 5; the temperature of the drum 20 is specific for the respective thermographic material. Pre-heating of the thermographic film 5 should not cause the film 5 to fog. However, the higher the selected pre-heating temperature for the film 5, the more power has to be supplied by the individual lasers of the laser row 10 to write on the film 5. It is therefore advantageous to precisely control the temperature of the drum 20 and to match the temperature to the specific selected thermographic film material.

The pressure rollers 21 and 22 in the present embodiment have a very small heat capacity, so as to limit the amount of thermal energy stored in the pressure rollers. In this way, the thermal energy stored in the pressure rollers cannot affect the writing process of the thermographic film 5. Alternatively or in addition, the same effect can be achieved by insulating the pressure rollers 21 and 22 so that they do not absorb heat.

Advantageously, the second pressure roller 22 can also be arranged so that the portion of the thermographic film 5 which has already been written, is removed very quickly from the circumferential surface of the drum 20. This prevents additional heating of the written portion of the film 5 which could otherwise cause additional unwanted blackening of the film 5. Accordingly, as indicated in FIG. 1, the spacing between the heating drum 20 and the first pressure roller 21 is smaller than the spacing between the heating drum 20 and the second pressure roller 22. However, the thermographic film 5 still has to be precisely guided, in particular to prevent the film 5 from buckling at the location of the row 15 which is to be written.

In the present embodiment, the thermographic film 5 has a width of 14" (=355.6 mm). Other film widths, for example, a width of 8" or 17", can also be used. A pixel of the thermographic film 5 has a fixed width of 80 $\mu$m, providing a resolution of 300 dpi. Two adjacent lasers of the laser row 10 then advantageously also have a fixed center-to-center spacing of 80 $\mu$m. A total of 4256 lasers are provided in the laser row 10 for writing a row of the thermographic film 5. A respective pixel of the row 15 of the thermographic film 5 is associated with each of these 4256 lasers.

The operation of the writing device 1 according to the invention will now be described. The information signal s(t) is applied to the laser row controller 14 at the input interface 16. The information signal s(t) contains information which is to be imaged on the thermographic film 5. The laser row controller 14 which controls the laser row 10 processes the information signal s(t) and produces a signal for addressing each laser of the laser row 10. In other words, in the present exemplary embodiment, 4256 signals are generated from the information signal s(t). The addressing signals generated by the laser row controller 14 directly modulate the individual lasers of the laser row 10. In the present exemplary embodiment, the individual lasers are controlled digitally by using, for example, pulse width modulated control signals. This arrangements allows the pixels of the thermographic film 5 associated with the individual lasers to be written with particular precision. The exposure duration of the pixels associated with the individual lasers determines the degree of blackening of the respective pixels. In this way, different gray levels can be is produced on the thermographic film 5. The digital control of the lasers represents an advantageous embodiment of the invention. It will be understood that the lasers can also be addressed in an analog manner. Processing the information signal s(t) in the laser row controller 14 is not part of the invention and can be adapted by those skilled in the art to the specific conditions.

In the present exemplary embodiment, the control signals produced by the laser row controller 14 address the lasers of the laser row 10 simultaneously. This arrangement allows the pixels of the row 15 of the thermographic material 5 to be written simultaneously. A row can advantageously be written on the thermographic material 5 by the laser row 10 in approximately 3 ms. This allows the thermographic film 5 to be completely written within a very short time.

Different rows can be written consecutively on the thermographic film 5 by rotating the heating drum 20 in the rotation direction A. The drum rotation is continuous, thereby obviating the need for a complex stepping motor to drive the heating drum 20. Accordingly, the thermographic film 5 is advanced in the feed direction B by the rotation of the heating drum 20.

The radiation energy of the laser beams of the individual lasers is converted by a particular layer disposed in the thermographic film 5 when the laser beam impinges on the thermographic film 5. The amount of the thermal energy depends on the intensity of the laser beam and the exposure duration. Since the laser in the present exemplary embodiment are addressed with pulse width modulated signals, the intensity of the laser beam can ideally only assume two states. The intensity of the laser beams is either equal to zero or equal to a maximum value which depends on the predetermined maximum output power of the individual lasers. The pixels of the film 5 associated with the individual lasers assume different optical densities depending on the produced thermal energy. Since the individual lasers are controlled digitally, the different densities (blackening) of the pixels of the film 5 depend on the exposure duration of the individual pixels.

A different radiation source can be used instead of the laser row 10, wherein the radiation source is composed of a plurality of individually addressable radiation sub-sources. It should be noted, however, that the output power of these radiation sub-sources should be high enough to blacken the pre-heated thermographic material, producing different density gradations. Alternatively, individually addressable heat sources may be used instead of the plurality of individually addressable radiation sub-sources. These individually addressable heat sources could then augment the thermal energy produced by pre-heating to generate the thermal energy necessary to write on the thermographic material. This arrangement would obviate the need of a special layer which converts the radiation energy into thermal energy in the thermographic material 5.

The writing device 1 of FIG. 1 is constructed so that the laser row 10 has as many lasers as are required to simultaneously write the pixels of an entire row of the thermographic film 5. One respective laser of the laser row 10 is here associated with one respective pixel. The laser row controller 14 converts the information signal s(t) into as many pulse width modulated signals as there are lasers in the laser row 10. Alternatively, the laser row controller 14 many generate a lesser number of control signals than there are lasers in the laser row 10. In this case, only a portion of the lasers can be addressed simultaneously by these control signals. The complete row 15 of the film 5 would then have to be written, for example, in two or more steps. Alternatively, the laser row 10 can also have a lesser number of lasers than there are pixels in a row of the film 5. In this case, the writing device according to the invention would have to move the thermographic film 5 relative to the laser row 10 along the direction of one of the rows of the film 5.

Figure 2:
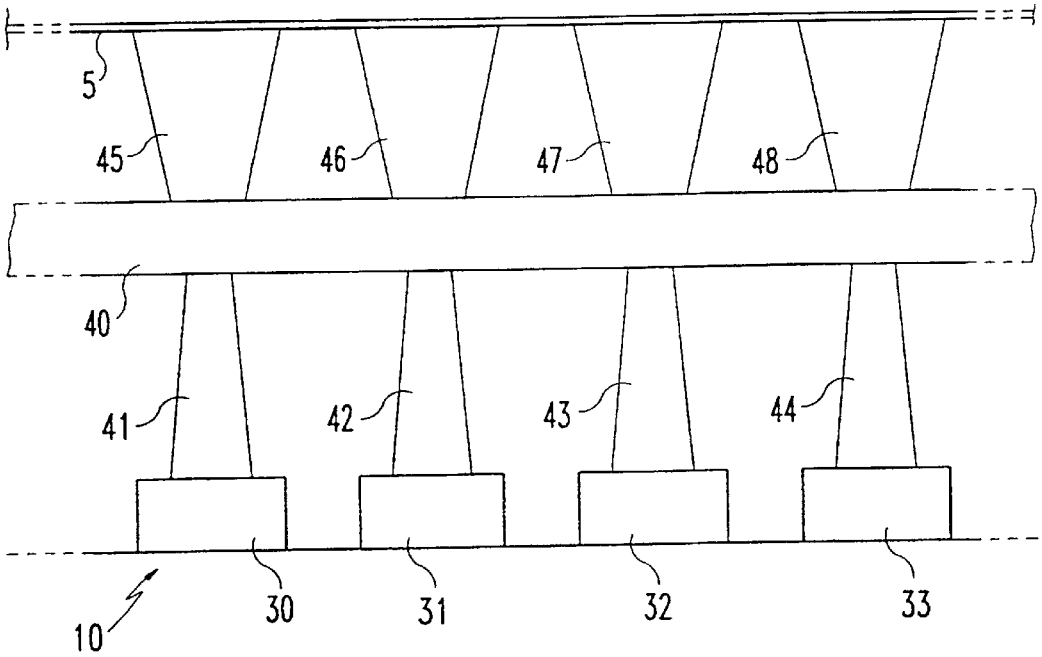

FIG. 2 shows a second embodiment of the device according to the invention depicting the beam path of the point sources in operation. In this example, the point sources are also lasers. FIG. 2 shows a section of the laser row 10 with four lasers 30–33 arranged side-by-side. The lasers 30 to 33 are shown in operation, when emitting a respective laser beam 41–44. The laser beams 41–44 in the present exemplary embodiment are directed perpendicular to the thermographic film 5 to be written. A lens 40 is disposed between the lasers 30–33 and the film 5. This lens 40 is a commercially available so-called SELFOC lens. The optical lens 40 is used to affect the radiation energies of the beam path 41–44 of the lasers 30 to 33 and to ensure that the laser beams of lasers 30–33 strike the thermographic film 5 exactly at the associated pixels. The beam path 41–44 of the lasers 30–33 is therefore converted by the optical lens 40 into the beam path 45–48 located between the lens 40 and the film 5. The lens should be able to focus or to defocus the beam paths depending on the characteristic features of the lasers 30–33 and the beam shape of the laser radiation 41–44 produced by these lasers.

Figure 3:
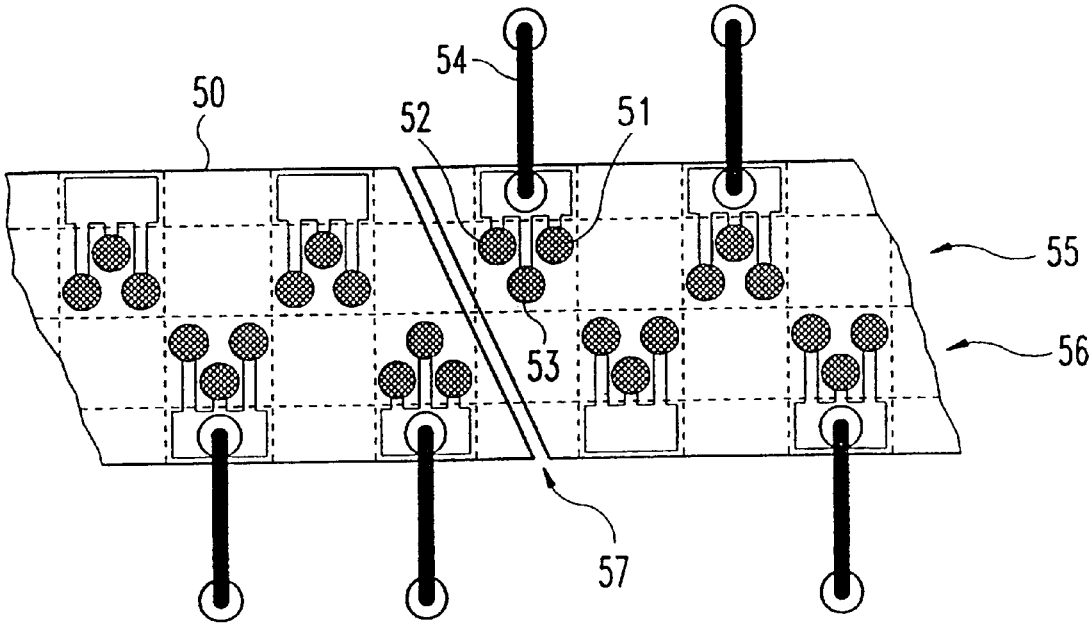

FIG. 3 shows a section consisting of an arrangement of several point sources, which in this exemplary embodiment are lasers, disposed on a semiconductor material. FIG. 3 depicts a plurality of lasers which are arranged on a semiconductor wafer 50, representing a portion of a laser row for writing on thermographic material. The lasers are arranged in groups, with each group having three sub-lasers. The sub-lasers of a group are connected in parallel and are used to simultaneously write a pixel of the thermographic material. A group of sub-lasers is represented in FIG. 3 showing a first sub-laser 51, a second sub-laser 52 and a third sub-laser 53. The control terminals of the three sub-lasers 51–53 are connected to the laser row controller 14 with a bonding wire 54. The pulse width modulated control signals are applied to the control terminals of the three sub-lasers 51–53 via this bonding wire 54. Since the three sub-lasers 51–53 are connected in parallel, they emit identical intensity modulated laser beams. Moreover, with several sub-lasers (in this exemplary embodiment the three sub-lasers 51–53) being arranged in parallel, the radiation energies of the three sub-lasers are superimposed in the associated pixel of the thermographic film 5. In this way, the output power of the individual sub-lasers can be kept small, while still maintaining a correspondingly high thermal energy for blackening of the film 5.

In the present exemplary embodiment illustrated in FIG. 3, the groups of sub-lasers are arranged side-by-side in two rows 55 and 56. The grouped sub-lasers of the first row 55 are offset with respect to the grouped sub-lasers of the second row 56. This arrangement produces channels on the semiconductor wafer between the individual laser groups; these channels can be used for cutting the semiconductor wafer when the laser row is fabricated. FIG. 3 shows such a channel 57 on the semiconductor wafer. An arrangement where the groups of sub-lasers are offset with respect to one another, is advantageous because during the fabrication of the laser rows many groups of sub-lasers are produced simultaneously on a semiconductor wafer, with the sub-lasers subsequently separated by sawing, scribing and cleaving. The saw cuts or cleaves should not be located too closely to the active structures of the laser row so as not to damage the lasers. The laser row controller 14 has to take the offset arrangement of the groups of sub-lasers into consideration when generating the pulse width modulated control signals. Accordingly, corresponding controls have to be implemented in the laser row controller 14.

Figure 4:
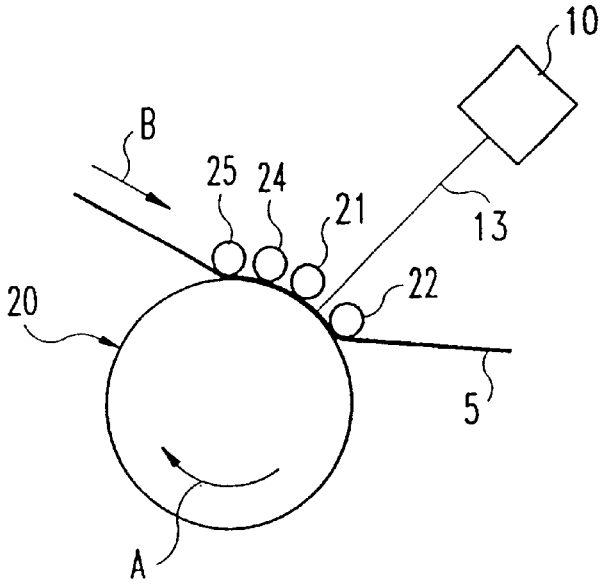

FIG. 4 shows a third embodiment of the device according to the invention having several pressure rollers which press the thermographic film 5 against the heating drum 20. According to FIG. 4, a third pressure roller 24 and a fourth pressure roller 25 are placed before the first pressure roller 21. Pre-heating the film 5 with several pressure rollers 21, 24 and 25 increases the length of the contact path between the thermographic film 5 and a surface of the heating drum 20 and consequently also the time during which the heating drum 20 pre-heats the thermographic film 5. In this way, the pre-heating conditions for thermographic material 5 can be tailored to different thermographic material. The duration of the pre-heating step can be extended or shortened depending on the composition and the characteristic properties of the different thermographic materials. In addition, the thermographic material 5 can be pre-heated more accurately to a temperature below the writing temperature.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A device for writing on thermographic material comprising a heater for pre-heating the thermographic material to a temperature below a writing temperature required for writing on the thermographic material;

a writing instrument for writing on the thermographic material according to a predefined information signal s(t), wherein the writing instrument is spaced apart from the thermographic material; wherein the writing instrument comprises a plurality of individually addressable point sources capable of writing on the thermographic material point-by-point;

wherein the plurality of individually addressable point sources are arranged in such a way that pixels of a row of the thermographic material can be written; wherein the plurality of individually addressable point sources can be addressed in such a way that the pixels of a row to be written by the point sources can be written simultaneously; wherein the plurality of individually addressable point sources are implemented so as to be capable of emitting a radiation which impinges on a layer of the thermographic material which is provided for converting the radiation into heat; wherein the point sources comprise lasers; and wherein several of the plurality of individually addressable point sources are connected in parallel and in combination are capable of writing a single pixel of the thermographic material.

2. A device for writing on thermographic material comprising a heater for pre-heating the thermographic material to a temperature below a writing temperature required for writing on the thermographic material;

a writing instrument for writing on the thermographic material according to a predetermined information signal s(t);

the writing instrument being spaced apart from the thermographic material, and comprises a plurality of individually addressable point sources capable of writing on the thermographic material point-by-point;

the plurality of individually addressable point sources being arranged in such a way that pixels of a row of the thermographic material are capable of being written;

the plurality of individually addressable point sources being addressable in such a way that the pixels of a row to be written by the point sources is adapted to be written simultaneously; wherein the plurality of individually addressable point sources are implemented so as to be capable of emitting a radiation which impinges on a layer of the thermographic material which is provided for converting the radiation into heat; and wherein the point sources comprise lasers arranged on a semiconductor material in two rows, the lasers of the one row being offset with respect to the lasers of the other row.

3. The device according to claim 2, wherein between the writing instrument and the thermographic material there is arranged a means for affecting the radiation emitted by the point sources to support point-by-point writing on the thermographic material.

4. The device according to claim 3, wherein the means for affecting the radiation is an optical lens.

5. The device according to claim 4, wherein the heater is a rotatably supported, heatable drum.

6. The device according to claim 5, further comprising a first pressure roller and a second pressure roller for pressing the thermographic material against the drum and the writing instrument is arranged so that the thermographic material can be written between the two pressure rollers.

7. The device according to claim 6, wherein at least one additional pressure roller is disposed after the first pressure roller.

8. The device according to claim 7, wherein the first and the second pressure rollers have a small heat capacity or are insulated to prevent absorption of heat.

9. The device according to claim 8, wherein there is provided a controller connected to the point sources, wherein the controller converts the information signal (s(t)) into a plurality of pulse width modulated signals.

* * * * *